United States Patent [19]

Pidgeon

[11] 4,430,980

[45] Feb. 14, 1984

[54] FUEL PUMP CUT-OFF CIRCUIT

[75] Inventor: Wilman A. Pidgeon, Huntsville, Ala.

[73] Assignee: Chrysler Corporation, Highland Park, Mich.

[21] Appl. No.: 495,274

[22] Filed: May 16, 1983

[51] Int. Cl.[3] ..... F02M 59/00

[52] U.S. Cl. ..... 123/497; 123/479

[58] Field of Search ..... 123/497, 498, 499, 479, 123/482

[56] References Cited

U.S. PATENT DOCUMENTS

| | | | |
|---|---|---|---|
| 3,669,081 | 6/1972 | Monpetit | 123/497 |
| 3,742,256 | 6/1973 | Frederiksen | 123/497 |
| 3,822,677 | 7/1974 | Reddy | 123/497 |
| 4,096,830 | 6/1978 | Long | 123/497 |

*Primary Examiner*—Ronald B. Cox

*Attorney, Agent, or Firm*—Newtson and Dundas

[57] ABSTRACT

A circuit for automatically controlling an internal combustion engine's electromagnetic fuel injection pump during the following three modes of operation: normal, low cranking and stall.

4 Claims, 5 Drawing Figures

FUEL PUMP CUT-OFF CIRCUIT

BACKGROUND AND SUMMARY OF THE INVENTION

The present invention relates to electronic fuel injection systems for internal combustion engines, and in particular to an electronic control circuit for controlling the energization of electromagnetic fuel injection pumps.

The circuit was incorporated into the fuel control circuitry as a safety feature and, possibly, as a fuel-saving device. The circuit controls the "ON" time of the fuel pump by monitoring the period of the input signal from a Hall effect transducer. In operation, the circuit makes an immediate comparison between the actual RPM detected by the circuit and a fixed RPM reference. The circuit selects one of three modes of operation:

Run Mode, Normal Operation

This mode of operation is selected when the actual engine RPM is above the reference RPM (30 RPM). The circuit energizes the fuel pump relay for 100% of the time.

Low Cranking Speed Mode

This mode of operation is selected when the engine RPM is below the reference RPM but above zero. The circuit energizes the fuel control relay coil for a time equal to the period of the reference RPM.

Stall Mode, Zero RPM with Key-On

This mode is typical of engine stall, a situation involving the key being in the "ON" position and the engine operating at zero RPM. The circuit detects the loss of RPM and de-energizes the fuel relay, thereby interrupting the fuel flow to the engine.

Thus, the present invention is an improved fuel pump cut-off control circuit for an electronic fuel injection system.

Additional objects and advantages of the present invention are apparent from the detailed description of the preferred embodiment, which makes reference to the following set of drawings in which:

DETAILED DESCRIPTION OF THE PREFERRED EMBODIMENT

Run Mode

Figure 1:
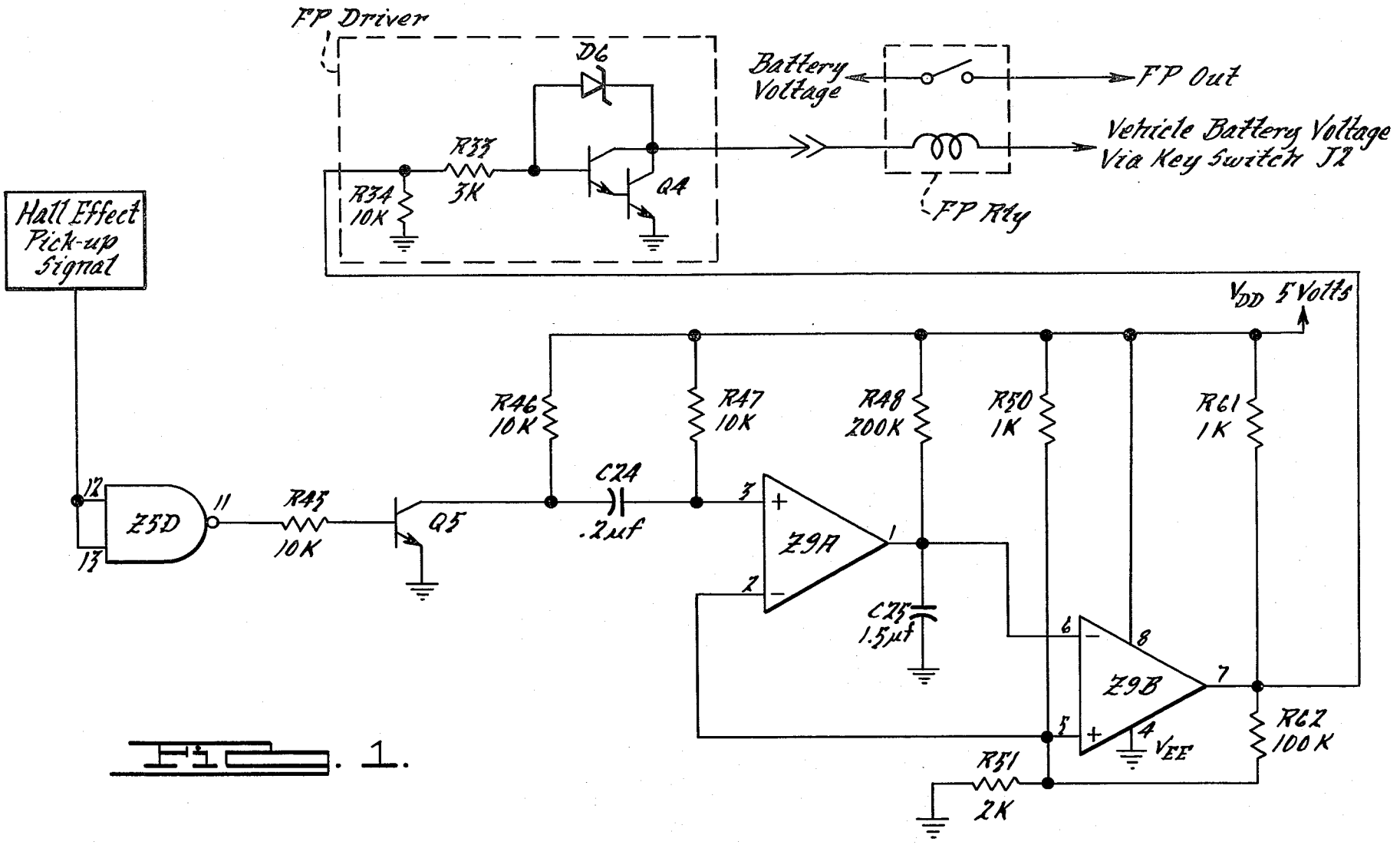
FIG. 1 is a circuit diagram of a fuel pump cut-off circuit according to the present invention; and FIG. *2a* is a timing diagram illustrating the operation of the fuel pump cut-off circuit in the Run Mode where the actual RPM is greater than the designated RPM; and FIG. *2b* is a timing diagram illustrating the operation of the fuel pump cut-off circuit in the Low Cranking Speed Mode where the actual RPM is less than the designated RPM; and FIG. *3a* is a timing diagram illustrating the operation of the fuel pump cut-off circuit in the Stall Mode where the engine is in a stall condition with the Hall pick-up signal at a high level; and FIG. *3b* is a timing diagram illustrating the operation of the fuel pump cut-off circuit in the Stall Mode where the engine is in a stalled condition with the Hall pick-up signal at a low level.

During the run mode (normal operation) the key switch J2 is "ON", the engine is running, and a typical square wave signal from the Hall effect distributor pick-up enters the circuit at gate Z5D. The square wave signal enters Z5D through pins 12 and 13, as shown in FIG. 1, which in turn inverts the signal at the output of gate Z5D at pin 11. This signal goes to the base of transistor Q5 and switches Q5 from a saturated to a cut-off state at the pick-up frequency.

When Q5 is saturated it forces pin 3 of comparator Z9A to a low voltage level. This low signal is below the reference level at pin 2 of Z9A which is determined by the divider network made up of resistors R50 and R51. The low at pin 3 forces the output of Z9A to a low state and shorts capacitor C25. The duration of this output low is relatively short and is determined by the RC time constant created by capacitor C24 and resistor R47.

With capacitor C25 in a shorted condition, pin 6 of comparator Z9B is below the reference level established by the divider network containing resistors R50 and R51 at pin 5. With a low at pin 6 the output of comparator Z9B at pin 7 goes high, forcing the Darlington transistor Q4 to saturate. This grounds the fuel pump relay and completes the circuit formed by the battery voltage via key switch J2, the fuel pump relay FPRLY and Darlington transistor Q4. This action energizes the fuel pump relay FPRLY which in turn energizes the fuel pump via the contacts of FPRLY.

The voltage level at pin 3 of comparator Z9A rapidly approaches the reference level of pin 2 as capacitor C24 charges at the rate determined by the RC network formed with capacitor C24 and resistor R47. When the voltage level on pin 3 exceeds the reference voltage on pin 2, the output of Z9A switches from low to high. Capacitor C25 is now allowed to charge slowly through resistor R48. The time constant determined by capacitor C25 and resistor R48 is designed to be equal to the period of the reference RPM (approximately 30 RPM). At or above the reference RPM, as in the normal Run Mode, capacitor C25 begins to charge increasing the potential on pin 6 but not great enough to exceed the threshold reference voltage on pin 5. The period of the reference RPM is equal to or greater than the period of any RPM at or above the reference RPM.

While capacitor C25 is charging, the signal from the Hall effect pick-up switches low and capacitor C24 discharges to zero. At speeds at or above the reference RPM, the Hall signal switches transistor Q5 from a cut-off to a saturation state before capacitor C25 charges above the reference potential on pin 5. With transistor Q5 in saturation again, pin 3 of comparator Z9A goes below the reference of pin 2, switching the output of Z9A at pin 1 to a low state which in turn discharges capacitor C25. Consequently, the potential of capacitor C25, which is the potential at pin 6 to gate Z9B, never exceeds the reference voltage at pin 5. Therefore, transistor Q4 will remain in saturation causing the fuel pump to be continuously energized. This is shown in FIG. *2a*.

Low Cranking Speed Mode

This Mode is very similar to the previous "Run" Mode. The signal from the Hall effect pick-up goes through comparator Z5D and switches transistor Q5 which in turn switches the output of comparator Z9A high and low. Capacitor C25 charges and discharges as it did in the Run Mode. However, due to the slower RPM, the period of the signal is longer than the reference period giving capacitor C25 more time to charge. The higher potential of C25 is reflected directly to pin 6 of comparator Z9B. In the Run Mode the potential at pin 6 never exceeded the reference at pin 5 causing the output of comparator Z9B to remain high. But, the reference potential on pin 5 is exceeded in the Low Cranking Speed Mode and the output of comparator Z9B now switches to low state. The low output causes the base of transistor Q4 to be low which in turn shuts Q4 "OFF". This de-energizes the fuel pump relay FPRLY, which opens the fuel pump contacts and the fuel pump stops temporarily.

Figure 2A:
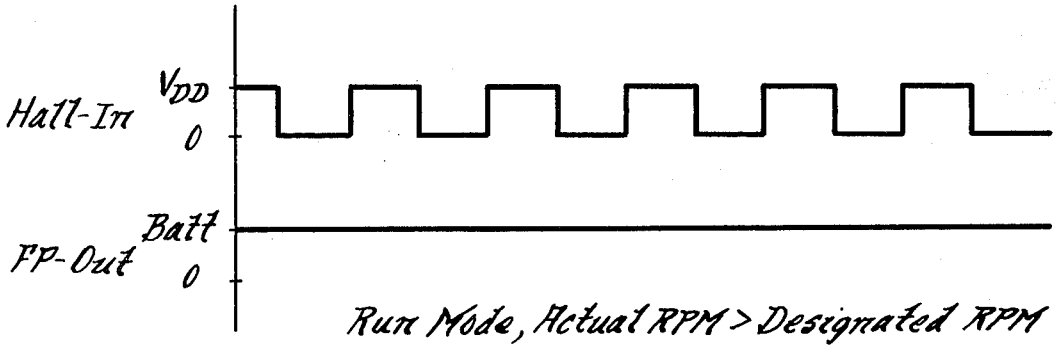
Figure 2B:
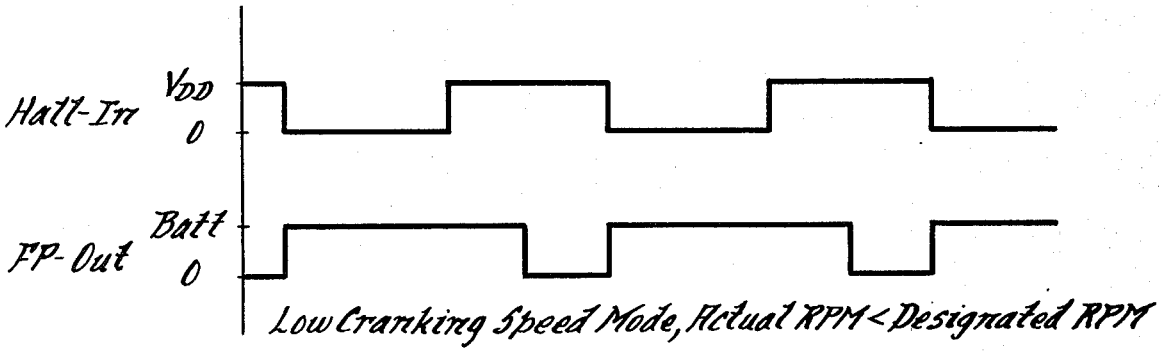

On the next trailing edge of the Hall signal, C25 is again shorted, Q4 is saturated and the fuel pump is reenergized. But, as long as engine RPM is below the reference RPM of 30 the fuel pump will be switched "ON" for the period of the reference RPM. The "OFF" time is equal to the difference between the period of the incoming signal and the period of the reference signal. This is shown in FIG. 2*b*.

Stall Mode

Figure 3A:
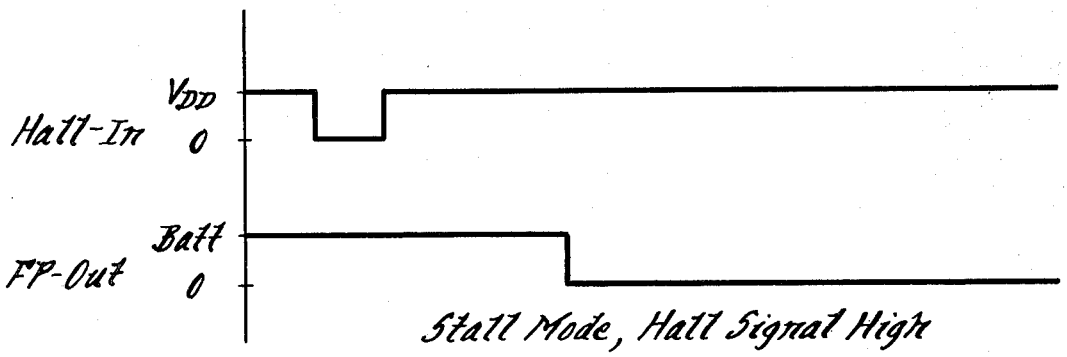
Figure 3B:
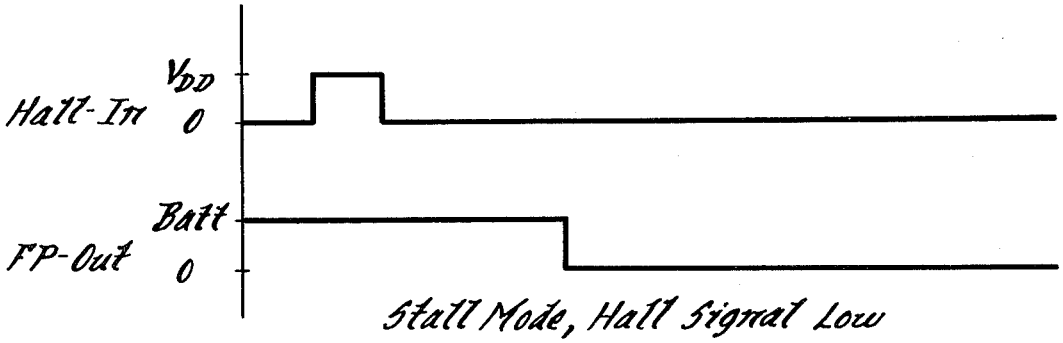

The Stall Mode utilizes the same concept that was discussed in the Low Cranking Speed Mode when the period of the incoming signal exceeded the reference RPM. If the engine stalls and the Hall signal was in the low state, Q5 would remain saturated. Capacitor C24 would eventually charge-up and the potential at pin 3 of comparator Z9A would exceed the reference at pin 2. The output of Z9A would switch high allowing C25 to charge. Eventually C25 would charge high enough to force the potential on pin 6 to exceed the reference on pin 5 of Z9B. The output at pin 7 of comparator Z9B goes low, forcing Q4 into cut-off and deenergizes the fuel pump relay. The fuel flow is interrupted and will remain off as long as there is no state change in the input signal from the Hall effect pick-up to restart the time sequence. This is shown in FIG. 3*b*.

In addition, during power-up, the output at pin 7 of comparator Z9B is forced high for the reference period of approximately one second. This allows the initial prime to reach the fuel system. A high level at pin 7, the output of comparator Z9B, turns transistor Q4 "ON" in a saturated state for a time equal to the reference period. A low output at pin 7 of comparator Z9B will turn transistor Q4 "OFF" preventing further de-activation of the fuel pump relay.

However, if the engine stalls and the signal from the Hall effect pick-up is in the high state, Q5 will be "OFF". The output at pin 1 of Z9A will be "OFF". If the charge voltage level on capacitor C25 is applied to pin 6 of Z9B and is less than the voltage reference on pin 5 of comparator Z9B, then pin 7 of Z9B remains high. This keeps transistor Q4 saturated with the relay and the fuel pump energized. When the charge on capacitor C25 at pin 6 of Z9B exceeds the reference level on Z9B at pin 5, transistor Q4 turns "OFF" and prevents further activation of the fuel pump relay in the fuel pump. This is shown in FIG. 3*a*.

While the above description constitutes the preferred embodiment of the present invention, the invention is susceptible to modifications, variations and changes that would not depart from the proper scope or fair meaning of the accompanying claims.

What is claimed is:

1. In an electronic fuel injection control system for an internal combustion engine having an electromagnetic fuel pump, a fuel pump relay, fuel metering means, a signal source of ignition pulses, and a supply voltage, a fuel pump cut-off circuit comprising:

a first comparator means;

a second comparator means;

a first wave shaping/timing means coupling said signal source of ignition pulses to the non-inverting input of said first comparator means;

said first wave shaping/timing means for reshaping said ignition pulses in a predetermined way to create a newly shaped pulse train which is one half the frequency of the said signal source of ignition pulses;

a reference voltage means which presents a preselected reference voltage to the inverting input of said first comparator means and to the non-inverting input of said second comparator means;

a second wave shaping/timing means for reshaping the output of said first comparator means in a predetermined way such that said signal source of ignition pulses below a preselected reference frequency will not cause a change in the output state of said second comparator means;

said second comparator means which accepts at its inverting input the output of said first comparator means as reshaped by said second timing means and accepts at its non-inverting input said preselected reference voltage from said reference voltage means; and fuel pump driver means connected to the output of said second comparator means and responding thereto for controlling the energization and deenergization of said fuel pump relay.

2. A fuel pump cut-off circuit of claim 1, wherein said first timing means comprises:

a capacitor connected between said signal source of ignition pulses and the non-inverting input to the first comparator means; and a resistor connected between the capacitor and the voltage supply.

3. The fuel pump cut-off circuit of claim 2 wherein said wave shaping/timing means comprises:

a resistor connected between said voltage supply and said output of first comparator means; and a capacitor connected between the output of said first comparator means and ground potential.

4. The fuel pump cut-off circuit of claim 3 wherein said fuel pump driver means comprises:

a current limiting resistor network connected to the output of said second comparator means;

a dual Darlington transistor amplifier, the base of which connects to said resistor network;

a Zener diode the end of which is connected to the base of said dual Darlington transistor amplifier and the cathode of which is connected to the collector of said dual Darlington transistor amplifier;

the emitter of said dual Darlington transistor amplifier being grounded and the collector of said amplifier being connected to complete the circuit between said fuel pump relay and the vehicle's battery voltage provided via the ignition switch.

* * * * *